US008054323B2

(12) United States Patent
Peters et al.

(10) Patent No.: US 8,054,323 B2
(45) Date of Patent: Nov. 8, 2011

(54) REVEAL SUBSTRATES AND METHODS OF USING SAME

(76) Inventors: Daniel F. Peters, Hamilton, OH (US); Ricky L. Helton, Mason, OH (US); John V. Guzzo, Easton, PA (US)

( * ) Notice: Subject to any disclaimer, the term of this patent is extended or adjusted under 35 U.S.C. 154(b) by 122 days.

(21) Appl. No.: 12/414,710

(22) Filed: Mar. 31, 2009

(65) Prior Publication Data

US 2010/0245524 A1 Sep. 30, 2010

(51) Int. Cl.
*B41J 2/32* (2006.01)
*B41M 5/28* (2006.01)

(52) U.S. Cl. ..... 347/221

(58) Field of Classification Search ..... 347/221
See application file for complete search history.

(56) References Cited

U.S. PATENT DOCUMENTS 3,953,659 A 4/1976 Truitt

FOREIGN PATENT DOCUMENTS

GB 1043541 * 9/1966

* cited by examiner

*Primary Examiner* — Huan Tran
(74) *Attorney, Agent, or Firm* — R. William Graham

(57) ABSTRACT

A reveal substrate includes a sensitive substrate having an opaque polymer sensitive to application of one of heat and pressure which upon one of being heated to a predetermined temperature and subjected to a predetermined pressure causes the opaque polymer to become transparent and a color material disposed in relation to the substrate in a manner to be obscured by the opaque polymer prior to one of the application of the predetermined heat and the predetermined pressure and is revealed subsequent thereto. A method of printing employing the reveal substrate is also provided.

54 Claims, 1 Drawing Sheet

REVEAL SUBSTRATES AND METHODS OF USING SAME

FIELD OF INVENTION

The invention relates to the field of printing. More particularly, the instant invention is directed to new printing substrates and method of using the same.

RELATED ART

Heat-sensitive material is common in the field of adhesive-backed heat-sensitive labels and other thermally sensitive paper stock used in printers and facsimile equipment. The labels are useful in packaging goods which, in transit, storage, or display, may be exposed to diverse solvents, and may be used on meat, produce, or articles of manufacture commonly exposed to water or other solvents. A bar code and/or alphanumeric information may be formed on such labels at the point of sale by imaging the label with a thermal print head.

The current state of thermal printing typically employs a substrate which is coated with a multitude of microcapsules or other separated heat sensitive material which renders a color upon being heated. For example, microcapsules are heat sensitive in that the microcapsule is opened to reveal the color composition contained therein by way of heat application. Such media of the type currently used are often exposed to unwanted ultraviolet rays, water, fats, oils, and other solvents which can have an adverse effect on the thermal image, increase background discoloration, and in some cases, destroy the machine readability of the imprinted image, such as bar codes.

Nevertheless, this type of substrate is typically used in the thermal fax paper or thermal receipt paper dispensed from store registers or gas stations, for example. This type paper provided an economical solution for such applications where a roll of thermal printable substrate is desired.

There remains a need to improve on such technology and reduce cost. Further, existing thermal substrates are sensitive to ultra violet light which causes the print to fade if left exposed to the sun and air as is commonly done by leaving the same in one's vehicle. Accordingly, the instant invention aims at overcoming the deficiencies of the prior art.

SUMMARY OF INVENTION

An object of the invention is to improve thermal or pressure printing.

Another object is to improve substrates for use in thermal or pressure printing.

Still another object is to provide a thermal or pressure reveal printable substrate.

A further object is to provide a thermal or pressure reveal printable substrate which is not UV sensitive.

Yet another object is to provide a thermal or pressure reveal printable substrate which provides an inexpensive solution to obscure sensitive information printed on the thermal printable substrate.

A further object is to provide a protective coating for thermal or pressure reveal print substrates.

Accordingly, the instant invention is directed to a thermal or pressure reveal substrate and methods of using the same. One embodiment of the invention is directed to a thermal reveal substrate which includes an opaque thermally or pressure sensitive substrate which upon being heated at high temperature or subjected to pressure renders an opaque aspect of the substrate transparent. A first side surface of the thermally or pressure sensitive substrate can preferably include a color material, such as ink, substantially covering the entire first side surface. The color can be of any desired. By virtue of the thermally or pressure sensitive substrate including an opacifying material, when viewed from a second side surface prior to any thermal application, such as a thermal print head, or print head pressure, the color material is obscured. Rather, the second side surface only shows an opaque color, which can be white for example. It is only upon heating or applying pressure that the first side surface color, such as black, is revealed. Thus, a reveal substrate includes a sensitive substrate having an opaque polymer sensitive to application of one of heat and pressure which upon one of being heated to a predetermined temperature and subjected to a predetermined pressure causes the opaque polymer to become transparent and a color material disposed in relation to the substrate in a manner to be obscured by the opaque polymer prior to one of the application of the predetermined heat and the predetermined pressure and is revealed subsequent thereto.

In a preferred embodiment, an adhesive material, such as pressure sensitive adhesive, can be applied to the first side surface over the ink, for example, to permit the thermal or pressure reveal sensitive substrate to be adhered to another surface. A release substrate can be applied to the adhesive. Optionally, a paper based substrate can be applied to the adhesive thereby forming a composite thermal or pressure reveal sensitive substrate which can be used as a thermal or pressure reveal sensitive paper based substrate. A method of printing employing the reveal substrate is also provided.

Other objects and advantages will be apparent upon reading the specification and viewing the drawings.

DETAILED DESCRIPTION OF THE PREFERRED EMBODIMENT

Figure 1:
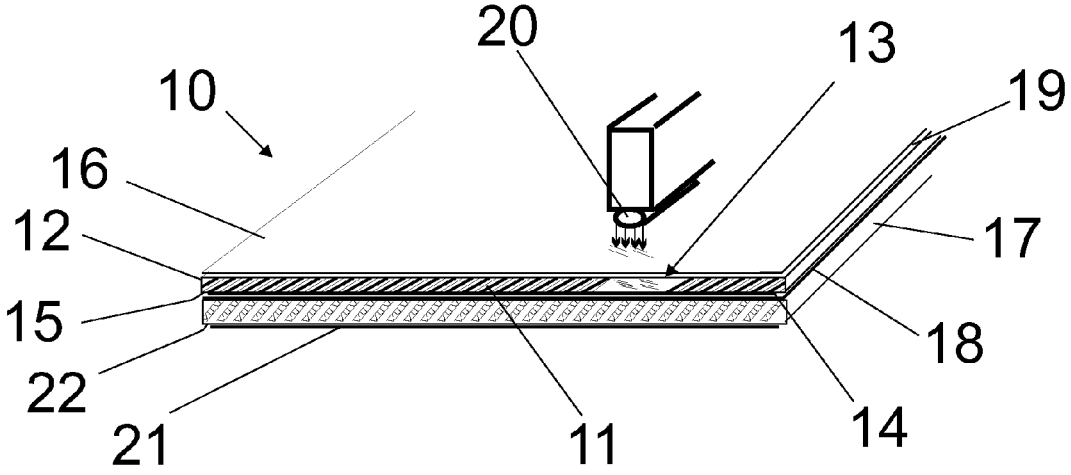
FIG. 1 is a perspective view of an embodiment of the invention.
Figure 2:
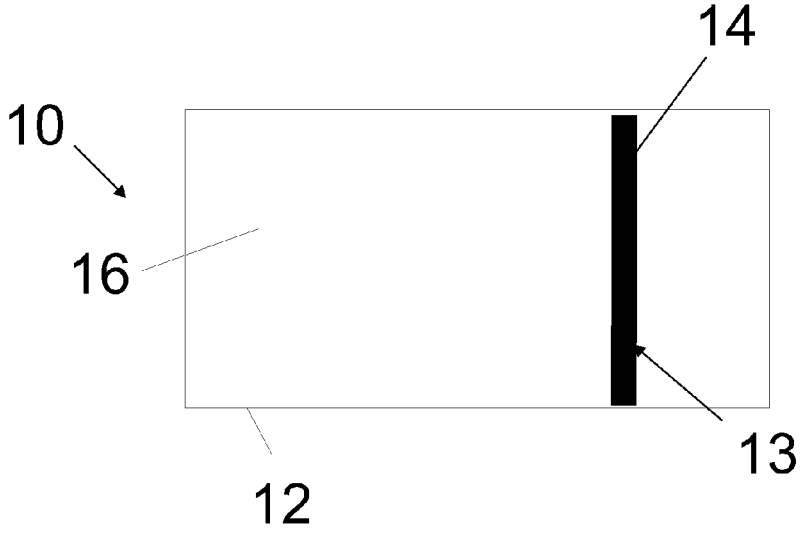
FIG. 2 is a top view of a thermally sensitive substrate formed after being subjected to a thermal print process.

Referring now to the drawings, a thermal or pressure reveal substrate of the present invention is generally referred to by the numeral 10. One embodiment of the invention is directed to a thermal and/or pressure reveal substrate 10 which includes a thermally and/or pressure sensitive substrate 12 having an opacifying material 11 which upon being heated at high temperature or subjected to pressure becomes transparent to reveal color material 14 as depicted in region 13 of FIG. 2.

A first side surface 15 of the substrate 12 can preferably include or be coated with color material 14, such as ink, covering substantially the entire first side surface 15. The color can be of any desired. By virtue of the thermally and/or pressure sensitive substrate 12 having opacifying material 11, when viewed from a second side surface 16 prior to any thermal pr pressure application, such as a thermal print head 20, the color material 14 is not viewable. The opacifying material 11 can be part of the physical make up of the thermal and/or pressure sensitive substrate 12. In a preferred embodiment, this can be accomplished by providing hollow polymer microspheres which appear white until broken by heat or pressure. Thus, second side surface 16 only shows opaque color, which can be white, for example. It is only upon application of high temperature heat or pressure that the color material 14, such as black, on the first side surface 15 is revealed.

The opacifying material 11 can be a hollow microsphere made of a styrene acrylic-copolymer which appears to eye of viewer as white or opaque when applied over a surface, and regardless of whether applied to a color or a clear surface, renders the viewed surface white. Upon applying a predetermined pressure or applying a predetermined heat via a print head 20, the microspheres are rendered non-opaque and the region 13 to which such print head 20 is applied enables transparency thus revealing the color material 14.

In a preferred embodiment, an adhesive material 18, such as pressure sensitive adhesive, can be applied to the first side surface 15 over the ink 14, for example, to permit the thermal and/or pressure sensitive substrate 12 to be adhered to another surface, such as a product package. A release substrate 17 can be applied to the adhesive 18. Optionally in lieu of release substrate 17, a paper based substrate 17 can be applied to the adhesive 18 thereby forming a composite thermal and/or pressure sensitive reveal substrate 10. The paper based substrate 17 may be mated to the thermal and/or pressure sensitive substrate 12 with the color material 14 contained therebewteen or as part thereof. PSA or other adhesive material can be employed to perform connection between the release substrate or paper substrate backing 17 and thermal and/or pressure sensitive substrate 12. The substrate backing 17 can include a color paper, film or board, for example.

The thermal and/or pressure sensitive substrate 12 can comprise polymer including styrene-acrylic copolymer (or equivalent) which in a preferred form can be a generally microspherical form provides opacifying material 11 and renders a white appearance by virtue of reflective properties in the polymer. The thermal and/or pressure sensitive substrate 12 can have a heat melting or transition property in the range from about 100° to 150° C. for printing applications.

Additionally, the thermal and/or pressure substrate 12 can include another coating 19 such as varnish as a protective element (a so-called over print lacquer) to protect the styrene-acrylic copolymer material 11. The coating 19 can be of a polymer material such as a modified styrene acrylic polymer which can be essentially transparent and has a higher melt point and pressure break point than styrene-acrylic copolymer material 11 to serve as a protective barrier for the underlying styrene-acrylic copolymer material 11 against normal user handling and exposure to elements of sun and heat, but permit melting and rupture of styrene-acrylic copolymer material 11 to effect printing as explained herein.

The thermal and/or pressure print head 20 can be employed to perform melting or pressure to transition from opaque to translucent and can do so in selected portions of thermal and/or pressure sensitive substrate 12. The thermal and/or pressure print head 20 can be equipped to provide a sufficient temperature or pressure to effect melting or pressure transition of the thermal and/or pressure sensitive substrate 12. Some applications may find it more suitable to provide the thermal and/or pressure sensitive substrate 12 with a lower transition state by employing low crosslinking technology. By selecting the proper polymer and blend styrene-acrylic co-polymer, the melting point is typically in the range 100 to 150° C. The grade of polymer can preferably have chemical resistance which does not melt at room temperature.

It is also contemplated that other polymers could be employed to accomplish another approach wherein a polymer such as polyesters having a suitable Glass transition state (Tg) which defines a pseudo second order phase transition in which a supercooled melt yields, on cooling, a glassy structure and properties similar to those of crystalline materials, e.g., of an isotropic solid material. Tg is usually applicable to wholly or partially amorphous solids such as common glasses and plastics (organic polymers). In this case, the thermal sensitive substrate 12 can include one or more opacifier such as titanium dioxide in a particulate form as an opacifier and white pigment. Particulate titanium dioxide for use as an opacifier in a polymer composition and products formed therefrom is widely available and can include titanium oxide, calcium carbonate, zinc white, white lead, lithopone, alumina white, white carbon, zirconium oxide, tin oxide, barium sulfate, barium carbonate, etc.

Here the thermally sensitive substrate 12 thus comprises a material appearing white and having an appropriate melting point for safe application use with a thermal print head 20. Thus, the thermal reveal substrate 10, when viewed from the first side surface 15, it appears white or of light color which precludes viewing the color material 14. Upon heating to effect a transition state of the polymer, the glass-like appearance is achieved and the opacifying material is tailored in an amount to reveal the color material 14 in a usable manner.

Unlike other prior art thermal activated paper, the instant invention is less sensitive to subsequent exposure of UV rays, luminescent lamps, perspiration of hands and fingers and slight rubbing or other solvents. By way of contrast the thermal and/or pressure reveal substrate 10 according to the present invention is an excellent one which solves all the above-mentioned various difficulties. The color revealed image can be any of various colors, such as, for example, black, red, dark purple, blue, etc. While it is conceived that traditional color-developing reaction materials can be employed in the instant invention, the instant invention provides a more secure, simpler and less expensive product. In addition to the product formed being more stable in typical ambient temperatures, it also provides for a quick and easy means for destroying sensitive information printed thereon, such as in the case of HIPAA labels. In this regard, the labels can simply be passed through a heated platen or pressure roller nips and the sensitive information will be rendered unreadable. In the case of forming labels, an adhesive material 18 can be applied either directly over the colored material 14 and surface side 15 or adhesive 21 can be applied to a back side 22 of paper substrate backing 17.

A thermal and/or pressure reveal substrate 10 is thus obtained which has of easy handling properties and is of good appearance and touch. According to further feature of the present invention, thermal and/or pressure sensitive substrate 12 suppresses aging and provides high stability for a long period as well as for enhancing contrast of thermally revealed images to solve the difficulty in reading such images.

Therefore, even when a highly transparent substrate such as a completely transparent film of polyethylene is used, the product after coating has a white appearance to distinctly contrast the heat revealed image. The amount of opacifying material should be such as to permit translucent effect to be achieved upon heating or pressure yet mask the colored material 14 prior thereto with the thermal and/or pressure print head 20. Thus, the present invention has succeeded in improving conventional thermal sheet material which is subject to spontaneous color-development (discoloration) in background from one or more of the reasons previously mentioned. The reveal substrate 10 provides for a superior color contrast by the thermal and/or pressure sensitive substrate 12 with its opacifying material 11 and renders a distinct image through the region 13.

An example to illustrate, but not to limit the invention, includes about 25 percent by weight styrene-acrylic copolymer opacifying material coated over a color paper substrate. A protective overprint varnish with higher heat resistance styrene-acrylic having melting point range exceeding that of styrene-acrylic copolymer opacifying material and which permits heat to radiate through it yet not melt to the print head 20 can be employed.

This invention has been described with respect the embodiments above. However, it should be realized that various modifications, changes and improvements may be made without departing from the scope of the invention and accordingly the claims appended hereto should be afforded such scope of protection.

What is claimed is:

1. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent; and a color material disposed in relation to said substrate in a manner to be obscured by said opaque polymer prior to one of said application of said predetermined heat and said predetermined pressure and is revealed subsequent thereto, wherein said opaque polymer is characterized to include an opacifier and a polymer with a Tg state which becomes transparent upon said application of said heat.

2. The reveal substrate of claim 1, wherein said polymer is substantially coated on a first surface.

3. The reveal substrate of claim 1, wherein said color material extends substantially across a surface of said substrate.

4. The reveal substrate of claim 1, wherein opaque polymer substantially covers said color material.

5. The reveal substrate of claim 4, wherein by virtue of said substrate being opaque when viewing from a second surface containing the opaque polymer prior to any said application thereto said color material is not viewable from said second surface.

6. The reveal substrate of claim 1, which includes an adhesive material applied to said substrate.

7. The reveal substrate of claim 6, wherein said adhesive is applied over said color material.

8. The thermal reveal substrate of claim 7, wherein said adhesive includes a pressure sensitive adhesive.

9. The reveal substrate of claim 8, which includes a release substrate having a mating surface applied over said color material and said pressure sensitive adhesive.

10. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent; and a color material disposed in relation to said substrate in a manner to be obscured by said opaque polymer prior to one of said application of said predetermined heat and said predetermined pressure and is revealed subsequent thereto, wherein said polymer has a melt point between about 100° C. and 150° C.

11. The reveal substrate of claim 10, wherein said polymer is substantially coated on a first surface.

12. The reveal substrate of claim 10, wherein said color material extends substantially across a surface of said substrate.

13. The reveal substrate of claim 10, wherein opaque polymer substantially covers said color material.

14. The reveal substrate of claim 13, wherein by virtue of said substrate being opaque when viewing from a second surface containing the opaque polymer prior to any said application thereto said color material is not viewable from said second surface.

15. The reveal substrate of claim 10, which includes an adhesive material applied to said substrate.

16. The reveal substrate of claim 15, wherein said adhesive is applied over said color material.

17. The thermal reveal substrate of claim 16, wherein said adhesive includes a pressure sensitive adhesive.

18. The reveal substrate of claim 10, wherein said polymer is substantially coated on a first surface.

19. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent; and a color material disposed in relation to said substrate in a manner to be obscured by said opaque polymer prior to one of said application of said predetermined heat and said predetermined pressure and is revealed subsequent thereto, which includes an adhesive material applied to said substrate.

20. The reveal substrate of claim 19, wherein said adhesive material is applied over said color material.

21. The thermal reveal substrate of claim 19, wherein said adhesive includes a pressure sensitive adhesive.

22. The reveal substrate of claim 21, which includes a release substrate having a mating surface applied over said color material and said pressure sensitive adhesive.

23. The reveal substrate of claim 21, which includes a paper based substrate having a mating surface applied over said color material and said pressure sensitive adhesive.

24. The reveal substrate of claim 19, wherein said polymer is substantially coated on a first surface.

25. The reveal substrate of claim 19, wherein said color material extends substantially across a surface of said substrate.

26. The reveal substrate of claim 19, wherein opaque polymer substantially covers said color material.

27. The reveal substrate of claim 26, wherein by virtue of said substrate being opaque when viewing from a second surface containing the opaque polymer prior to any said application thereto said color material is not viewable from said second surface.

28. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent; and a color material disposed in relation to said substrate in a manner to be obscured by said opaque polymer prior to one of said application of said predetermined heat and said predetermined pressure and is revealed subsequent thereto, which includes a release substrate applied over said color material.

29. The reveal substrate of claim 28, wherein said color material extends substantially across a surface of said substrate.

30. The reveal substrate of claim 28, wherein opaque polymer substantially covers said color material.

31. The reveal substrate of claim 28, wherein by virtue of said substrate being opaque when viewing from a second surface containing the opaque polymer prior to any said application thereto said color material is not viewable from said second surface.

32. The reveal substrate of claim 31, wherein said adhesive is applied over said color material.

33. The reveal substrate of claim 32, which includes a release substrate having a mating surface applied over said color material and said pressure sensitive adhesive.

34. The reveal substrate of claim 28, which includes an adhesive material applied to said substrate.

35. The thermal reveal substrate of claim 34, wherein said adhesive includes a pressure sensitive adhesive.

36. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent; and a color material disposed in relation to said substrate in a manner to be obscured by said opaque polymer prior to one of said application of said predetermined heat and said predetermined pressure and is revealed subsequent thereto, which includes a paper based substrate applied over said color material.

37. The reveal substrate of claim 36, which includes a paper based substrate having a mating surface applied over said color material and a pressure sensitive adhesive.

38. The reveal substrate of claim 36, which includes an adhesive material applied to surface of said paper based substrate.

39. The reveal substrate of claim 38, wherein said adhesive is a pressure sensitive adhesive.

40. A method of thermal printing, which includes the steps of:

(a) employing a reveal substrate having sensitive substrate having an opaque polymer sensitive to application of one of heat and pressure which upon one of being heated to a predetermined temperature and subjected to a predetermined pressure causes said opaque polymer to become transparent and a color material disposed in relation to said substrate in a manner to be obscured by said opaque polymer prior to one of said application of said predetermined heat and said predetermined pressure and is revealed subsequent thereto;

(b) employing a printing device to cause one of said application of heat and pressure to a region of said sensitive substrate to render a useful and readable printed reveal substrate having visible said color material through said region; and (c) passing said sensitive substrate through one of a heated platen and pressure nip to obscure said region of said sensitive substrate rendering said printed reveal substrate unreadable.

41. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent;

a color material disposed in relation to said substrate in a manner to be obscured by said opaque polymer prior to one of said application of said predetermined heat and said predetermined pressure and is revealed subsequent thereto, wherein said opaque polymer includes a microsphere polymer which appears opaque as a result of reflective properties; and an adhesive material applied to said substrate.

42. The reveal substrate of claim 41, wherein said polymer is substantially coated on a first surface.

43. The reveal substrate of claim 41, wherein said color material extends substantially across a surface of said substrate.

44. The reveal substrate of claim 43, wherein opaque polymer substantially covers said color material.

45. The reveal substrate of claim 44, wherein by virtue of said substrate being opaque when viewing from a second surface containing the opaque polymer prior to any said application thereto said color material is not viewable from said second surface.

46. A reveal substrate, which comprises:

a sensitive substrate having an opaque polymer sensitive to application of one of heat and pressure which upon one of being heated to a predetermined temperature and subjected to a predetermined pressure causes said opaque polymer to become transparent; and a color material disposed in relation to said substrate in a manner to be obscured by said opaque polymer prior to one of said application of said predetermined heat and said predetermined pressure and is revealed subsequent thereto, wherein said opaque polymer includes styrene acrylic-copolymer; and an adhesive material applied to said substrate.

47. The reveal substrate of claim 46, wherein said polymer is substantially coated on a first surface.

48. The reveal substrate of claim 46, wherein said color material extends substantially across a surface of said substrate.

49. The reveal substrate of claim 46, wherein opaque polymer substantially covers said color material.

50. The reveal substrate of claim 49, wherein by virtue of said substrate being opaque when viewing from a second surface containing the opaque polymer prior to any said application thereto said color material is not viewable from said second surface.

51. The reveal substrate of claim 50, wherein said adhesive is applied over said color material.

52. The thermal reveal substrate of claim 51, wherein said adhesive includes a pressure sensitive adhesive.

53. The reveal substrate of claim 52, which includes a release substrate having a mating surface applied over said color material and said pressure sensitive adhesive.

54. The reveal substrate of claim 46, wherein said adhesive is applied over said color material.

* * * * *